US011926797B2

(12) United States Patent
Dion et al.

(10) Patent No.: US 11,926,797 B2
(45) Date of Patent: Mar. 12, 2024

(54) METHOD OF REMOVAL AND CONVERSION OF AMINES IN A REFINERY DESALTER

(71) Applicant: BL TECHNOLOGIES, INC., Minnetonka, MN (US)

(72) Inventors: Michael Dion, Minnetonka, MN (US); Peter L Perez Diaz, Minnetonka, MN (US); Nimeshkumar Patel, Minnetonka, MN (US); Hitesh Bagaria, Minnetonka, MN (US); Gregory Kaplan, Minnetonka, MN (US)

(73) Assignee: BL TECHNOLOGIES, INC., Minnetonka, MN (US)

( * ) Notice: Subject to any disclaimer, the term of this patent is extended or adjusted under 35 U.S.C. 154(b) by 10 days.

(21) Appl. No.: 17/626,101

(22) PCT Filed: Jul. 2, 2020

(86) PCT No.: PCT/US2020/040618
§ 371 (c)(1),
(2) Date: Jan. 10, 2022

(87) PCT Pub. No.: WO2021/011204
PCT Pub. Date: Jan. 21, 2021

(65) Prior Publication Data

US 2022/0259507 A1 Aug. 18, 2022

Related U.S. Application Data

(60) Provisional application No. 62/875,045, filed on Jul. 17, 2019.

(51) Int. Cl.
*C10G 29/24* (2006.01)
*C10G 75/02* (2006.01)

(52) U.S. Cl.
CPC ..... *C10G 29/24* (2013.01); *C10G 75/02* (2013.01); *C10G 2300/4075* (2013.01)

(58) Field of Classification Search
CPC . C10G 29/24; C10G 75/02; C10G 2300/4075
See application file for complete search history.

(56) References Cited

U.S. PATENT DOCUMENTS 4,680,127 A * 7/1987 Edmondson ..... C02F 1/20 422/5
5,292,958 A 3/1994 Claud et al.
(Continued)

FOREIGN PATENT DOCUMENTS

WO 1998028381 A1 7/1998
WO 2018218641 A1 12/2018

OTHER PUBLICATIONS

International Search Report and Written Opinion for International Application No. PCT/US2020/040618, dated Sep. 17, 2020, 12 pages.

(Continued)

*Primary Examiner* — Brian A McCaig
(74) *Attorney, Agent, or Firm* — Armstrong Teasdale LLP

(57) ABSTRACT

A method of scavenging ammonia and amines, the method having the steps of (i) providing an aldehyde-based scavenger composition; and (ii) adding the aldehyde-based scavenger composition to a hydrocarbon.

20 Claims, 6 Drawing Sheets

(56) References Cited

U.S. PATENT DOCUMENTS

| | | | | |
|---|---|---|---|---|
| 5,350,503 | A * | 9/1994 | Freymeyer | C10B 57/045 208/50 |
| 7,517,447 | B2 | 4/2009 | Gatlin | |
| 8,366,915 | B2 | 2/2013 | Goliaszewski et al. | |
| 8,840,781 | B2 | 9/2014 | Subramaniyam | |
| 9,790,438 | B2 | 10/2017 | Garcia, III et al. | |
| 2011/0147272 | A1 | 6/2011 | Karas et al. | |
| 2011/0155646 | A1 | 6/2011 | Karas et al. | |
| 2012/0067783 | A1 * | 3/2012 | Kaplan | C10G 75/00 252/189 |
| 2012/0255914 | A1 | 10/2012 | Kaplan et al. | |
| 2013/0299734 | A1 | 11/2013 | Yang et al. | |
| 2018/0216013 | A1 | 8/2018 | Weers | |
| 2020/0123451 | A1 * | 4/2020 | Poukalov, Sr. | C10G 1/00 |

OTHER PUBLICATIONS

Arnauld et al., "ROMPGEL Scavengers:? A High-Loading Supported Anhydride for Sequestering Amines and Hydrazines", Organic Letters, (Aug. 1, 2000), vol. 2, No. 17, doi: 10.1021/01006191s, ISSN 1523-7060, pp. 2663-2666, XP055034937.

Kuklenz, "Degradation of Carboxylic Acids and the Associated Impact on Feed Prep and Overhead Corrosion", Paper No. NACE-2017-9289, Paper presented at the CORROSION 2017, New Orleans, Louisiana, USA, Mar. 2017.

Kliegman et al., Tetrahedron, Elsevier, 1970, 26, 2555-2560.

English translation of Office Action and Search Report issued in Chinese Patent Application No. 202080051562.2, dated Jan. 18, 2023, 14 pages.

* cited by examiner

METHOD OF REMOVAL AND CONVERSION OF AMINES IN A REFINERY DESALTER

CROSS-REFERENCE TO RELATED APPLICATION

This application is a national phase of International Patent Application No. PCT/US2020/040618 filed Jul. 2, 2020, which claims the priority benefit of U.S. Provisional Patent Application Ser. No. 62/875,045 filed Jul. 17, 2019, the entireties of which are incorporated by reference.

FIELD OF INVENTION

The disclosed technology generally provides for a method of scavenging ammonia and amines, and more specifically, a method of scavenging amines by providing an aldehyde-based compound in a hydrocarbon production, transportation, and processing application, including refinery desalter or post-desalter, to reduce or remove the concentration of amines in a hydrocarbon.

BACKGROUND OF THE INVENTION

Refiners are not only concerned with acid related corrosion due to hydrolysis of metal chloride salts, but also under deposit corrosion from amine chloride salt formation ahead of water condensation. In some instances, the amine chloride can deposit within the crude unit fractionator and top pump-around circuit. The prevalence of amine chloride corrosion has increased within the industry due to shale oil crudes, upgraded crudes and the use of hydrogen sulfide scavengers in the oil field (typically MEA or MA based triazine). As such, amine chloride salt corrosion risks the integrity of equipment and safety of personnel and the environment from unplanned metal failure.

Refiners will try to control such amine chloride salt deposition by increasing overhead tower top temperature, changing steam rates in fractionators, and the use of caustic in the desalted crude to minimize overhead chlorides. However, increasing tower top temperatures can reduce diesel production, stripping steam can impact fractionation efficiency, caustic can accelerate fouling in downstream units, all of which deteriorate refiner efficiency and profits, and limit their ability to confidently process lower cost opportunity crudes.

Amines present in crude oil may be naturally occurring or from upstream additives in crude oil production and/or transportation. Additionally, some compounds, such as triazine and their reaction products, may degrade in crude unit furnaces to form amines which can cause corrosion and other complications.

To maximize profits, refiners are challenged to process any type of opportunity crude with confidence. This means processing lower cost crudes without risking asset integrity, unit run lengths, and/or Environmental, Health, and Safety (EHS) Guidelines. One method to reduce amine concentrations in crude unit fractionators is through the use of acid to reduce the effluent brine pH in the crude unit desalter. However, pH reduction increases the partitioning of amines to the brine but does not completely remove the amines. Residual amines can still be present and can inhibit the refiner's ability to safely process lower cost crude oils. Additionally, the current practices of extracting amines by reducing effluent brine pH does not address the amines formed through degradation downstream of desalter, nor those used elsewhere in the refinery that end up in overhead water.

Thus, what is needed in the art is a method of removal and conversion of amines in the refinery upstream and/or a desalter application and/or downstream of the desalter to reduce the concentration of amines in desalted crude and/or those amines found downstream from the desalter.

SUMMARY OF THE INVENTION

The disclosed technology generally provides for a method of scavenging ammonia and amines, and more specifically, a method of scavenging amines by providing an aldehyde-based compound in a hydrocarbon production, transportation, and processing application, including refinery desalter or post-desalter, to reduce or remove the concentration of amines in a hydrocarbon In one aspect of the disclosed technology, a method of scavenging ammonia and amines is provided. The method comprises (i) providing an aldehyde-based scavenger composition; and (ii) adding the aldehyde-based scavenger composition to a hydrocarbon.

In some embodiments, the aldehyde-based scavenger composition comprises glyoxal, tetrahydroxyethane, dihydroxymethyl dioxolanediol, bi-dioxolane tetrol, and/or a combination thereof. In some embodiments, the aldehyde-based scavenger composition comprises formaldehyde, methylene glycol, oxymethylene oligomers and/or a combination thereof. In some embodiments, the aldehyde-based scavenger composition comprises a reaction product of an aldehyde and an alcohol. In some embodiments, the aldehyde comprises glyoxal, formaldehyde, glutaraldehyde and/or a combination thereof, and the alcohol comprises methanol, ethanol, propanol, isopropanol, glycerol, ethylene glycol, propylene glycol, diethylene glycol, triethylene glycol and/or a combination thereof.

In some embodiments, the aldehyde-based scavenger composition is provided in combination with a pH reduction agent. In some embodiments, the pH reduction agent comprises inorganic acids or their salts, organic acids or their salts, and/or a combination thereof. In some embodiments, the pH reduction agent comprises citric acid, sodium tripolyphosphate, polyacrylic acid, tartaric acid, and/or sodium hexametaphosphate.

In some embodiments, the hydrocarbon comprises a plurality of amines. In some embodiments, the plurality of amines comprise cyclohexylamine, di-butyl amine, diethanolamine, diethyl ethanolamine, diethylhydroxylamine, diethylenetriamine, diglycolamine, diethyl amine, dimethylamine, dipropyl amine, dimethylisoproponolamine, dimethylaminoethanol, dimethylaminopropylamine, ethyl amine, dithiazine ethanol, ethylene diamine, methylamine, isopropyl amine, N-methyldiethanolamine, monoethanol amine, 2-Methylaminoethanol, methyl dithiazane, monoisopropanolamine, morpholine, methoxypropylamine, N-Ethyldiethanolamine, propyl amine, N-Ethyl morpholine, ethyl methyl amine, 3-Picoline, N-methyl morpholine, piperazine, triethanol amine, triethyl amine, trimethyl amine, urea, NN'-Bis(2-(2-hydroxyethoxy)ethyl)urea, 11'-(hydroxyimino)bis-2-propanol, pyridine, NN-Bis(2-hydroxyethyl) ethylenediamine, NNN'-Tris(2-hydroxyethyl)ethylenediamine, NNN'N'-Tetrakis(2-hydroxyethyl)ethylenediamine, NN-diethylethylenediamine, N-Ethyl-Piperazine, and/or NN'-Bis(2-(2-hydroxyethoxy)ethyl)thiourea.

In some embodiments, the aldehyde-based scavenger composition is present at a ratio of about 1:9 to about 9:1 based on the total amines present in the hydrocarbon.

In some embodiments, the aldehyde-based scavenger composition is added to the hydrocarbon in (i) a single stage desalter process, (ii) a second stage of a two-stage desalter process, (iii) in all stages of a multi-stage desalting process, (iv) in the desalted crude, or (v) in fractionator pump-arounds or naphtha overhead recycle. In some embodiments, the plurality of amines are present in a plurality of overhead lines, reflux, and/or top pump-around circuits within a refinery process.

In yet another aspect of the disclosed technology, a method of scavenging amines is provided. The method comprises (i) providing an aldehyde-based composition; and (ii) adding the aldehyde-based composition to crude oil.

In some embodiments, the aldehyde-based scavenger composition comprises (i) glyoxal, (ii) a reaction product of ethylene glycol and formaldehyde, and/or (iii) a reaction product of glycerol and formaldehyde. In some embodiments, the aldehyde-based scavenger provides at least about 25%-100% reduction in total amines present in the crude oil. In some embodiments, about 1-1500 ppm of the aldehyde-based scavenger composition is added to the crude oil.

In some embodiments, the crude oil comprises a hydrocarbon, a raw crude oil, or a desalted crude. In some embodiments, the crude oil comprises a plurality of amines. In some embodiments, the plurality of amines comprise cyclohexylamine, di-butyl amine, diethanolamine, diethylethanolamine, diethylhydroxylamine, diethylenetriamine, diglycolamine, diethyl amine, dimethylamine, dipropyl amine, dimethylisoproponolamine, dimethylaminoethanol, dimethylaminopropylamine, ethyl amine, dithiazine ethanol, ethylene diamine, methylamine, isopropyl amine, N-methyldiethanolamine, monoethanol amine, 2-Methylaminoethanol, methyl dithiazane, monoisopropanolamine, morpholine, methoxypropylamine, N-Ethyldiethanolamine, propyl amine, N-Ethyl morpholine, ethyl methyl amine, 3-Picoline, N-methyl morpholine, piperazine, triethanol amine, triethyl amine, trimethyl amine, urea, NN'-Bis(2-(2-hydroxyethoxy)ethyl)urea, 11'-(hydroxyimino)bis-2-propanol, pyridine, NN-Bis(2-hydroxyethyl)ethylenediamine, NNN'-Tris(2-hydroxyethyl)ethylenediamine, NNN'N'-Tetrakis(2-hydroxyethyl)ethylenediamine, NN-diethylethylenediamine, N-Ethyl-Piperazine, and/or NN'-Bis(2-(2-hydroxyethoxy)ethyl)thiourea. In some embodiments, the plurality of amines comprise monoethanolamine, methoxypropylamine, diethanolamine, methylamine, dimethylethanolamine, dimethylisopropanolamine, and/or N-methylmorpholine.

In some embodiments, the aldehyde-based scavenger reacts with the plurality of amines present in the crude oil to form non-salting molecules.

In yet another aspect of the disclosed technology, a method of scavenging amines in desalted crude is provided. The method comprises (i) providing a providing an aldehyde-based composition; and (ii) adding the providing the aldehyde-based composition directly into desalted crude.

In some embodiments, the desalted crude comprises a plurality of amines comprising cyclohexylamine, di-butyl amine, diethanolamine, diethylethanolamine, diethylhydroxylamine, diethylenetriamine, diglycolamine, diethyl amine, dimethylamine, dipropyl amine, dimethylisoproponolamine, dimethylaminoethanol, dimethylaminopropylamine, ethyl amine, dithiazine ethanol, ethylene diamine, methylamine, isopropyl amine, N-methyldiethanolamine, monoethanol amine, 2-Methylaminoethanol, methyl dithiazane, monoisopropanolamine, morpholine, methoxypropylamine, N-Ethyldiethanolamine, propyl amine, N-Ethyl morpholine, ethyl methyl amine, 3-Picoline, N-methyl morpholine, piperazine, triethanol amine, triethyl amine, trimethyl amine, urea, NN'-Bis(2-(2-hydroxyethoxy)ethyl)urea, 11'-(hydroxyimino)bis-2-propanol, pyridine, NN-Bis(2-hydroxyethyl)ethylenediamine, NNN'-Tris(2-hydroxyethyl)ethylenediamine, NNN'N'-Tetrakis(2-hydroxyethyl)ethylenediamine, NN-diethylethylenediamine, N-Ethyl-Piperazine, and/or NN'-Bis(2-(2-hydroxyethoxy)ethyl)thiourea. In some embodiments, the desalted crude comprises a plurality of amines selected from the group consisting of monoethanolamine, methoxypropylamine, and diethanolamine.

In some embodiments, the aldehyde-based composition comprises glyoxal. In some embodiments, the glyoxal is present at a ratio of about 1:1 based on the total amines present in the desalted crude. In some embodiments, the glyoxal composition is present at a ratio of about 5:1 based on the total amines present in the desalted crude. In some embodiments, the aldehyde-based scavenger composition is present at a ratio of about 1:9 to about 9:1 based on the total amines present in the desalted crude.

In some embodiments, the glyoxal provides a conversion percentage of at least about 25-100% of total amines present in the desalted crude. In some embodiments, about 1-1500 ppm of the glyoxal composition is added to the desalted crude. In some embodiments, about 250 to 1500 ppm of the glyoxal composition is added to the desalted crude. In some embodiments, the glyoxal provides an amine extraction percentage of at least about 0.5-50% from the desalted crude.

BRIEF DESCRIPTION OF SEVERAL VIEWS OF THE DRAWINGS

These and other features of the disclosed technology, and the advantages, are illustrated specifically in embodiments now to be described, by way of example, with reference to the accompanying diagrammatic drawings, in which.

DETAILED DESCRIPTION OF EXEMPLARY EMBODIMENTS

Figures 1A, 1B:
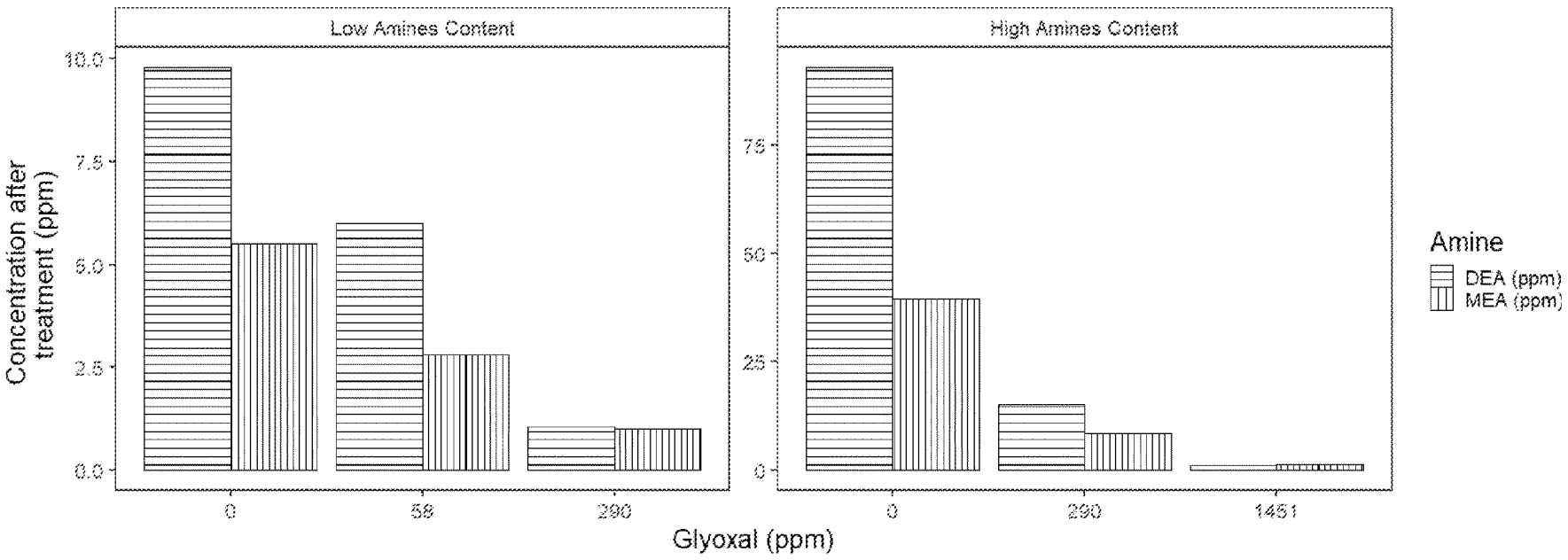
FIGS. 1A-B provide results of an illustrative embodiment of the disclosed technology.

The disclosed technology generally provides for a method of scavenging ammonia and amines, and more specifically, a method of scavenging amines by providing an aldehyde-based compound in a hydrocarbon production, transportation, and processing application, including a refinery desalter or post-desalter, to reduce or remove the concentration of amines in a hydrocarbon.

As used herein, the term "scavenging" or "scavenges" should be understood to mean the extraction/removal of ammonia and/or amines, or the conversion of amines, to otherwise reduce the amount of ammonia and/or amines present in a hydrocarbon, and is used interchangeably with "extraction of", "removal of" and "conversion of" ammonia and/or amines as it relates to the present technology.

As used herein, the term "hydrocarbon" should be understood to include, but is not limited to, crude oil, desalted crude oil, slop oil, or other refinery products including fractionator product pump-arounds and recycle streams; crude oil streams such as, but not limited to, light crude oil, heavy crude oil, extra-heavy crude oil; or other types of crudes, such as, but not limited to shale oil, light tight oils, and other unconventional crude oils.

With the present technology, the use of the disclosed aldehyde-based composition in a desalter application aids in reducing the concentration of amines by converting amines into different chemistries that are less harmful or are removed into effluent brine, which thereby reduces amine presence in the fractionator and overhead systems. Refiners are therefore able to process a greater range/variety and higher quantities/amounts of opportunity crudes containing tramp amines (which are created through either the addition of neutralizing amines in crude unit overhead or steam boilers, or decomposition of molecules such as triazine in the crude unit furnace), which can then reduce the recycle concentration and effect on overhead salt corrosion when overhead condensate is used as desalter wash water, thus simultaneously sustaining refinery unit integrity and reliability. Additionally, the refiner will have greater flexibility in gasoline and/or diesel production through reduced tower top temperature with reduction in salt point.

The present technology provides for a method of scavenging ammonia and amines. The method comprises (i) providing an aldehyde-based scavenger composition; and (ii) adding the aldehyde-based scavenger composition to a hydrocarbon.

It should be understood that the hydrocarbon as described herein can be present in any conventional refinery process, such as, but not limited to, a static, batch or continuous refinery process. Typically, with double extraction of amines in a desalter, acid is injected into the wash water that is directed to first stage desalter. For multi-stage systems, adding acid into the first stage will extract tramp amines, while adding acid to second stage will help break amine recycle loops that may exist from using wash water containing amines from other portions of the plant. Therefore, the disclosed aldehyde-based composition provides the benefit of being added to a single stage desalter, or a second stage desalter, or added to both stages contemporaneously, in order to reduce or remove the concentration of amines in a hydrocarbon. In some embodiments, the disclosed aldehyde-based scavenger composition can also be injected into the desalted crude and other hydrocarbon streams to further reduces amines in overhead lines, reflux, and/or top pump-around circuits.

In some embodiments, the aldehyde-based scavenger composition comprises glyoxal, tetrahydroxyethane, dihydroxymethyl dioxolanediol, bi-dioxolane tetrol, and/or a combination thereof. In other embodiments, the aldehyde-based scavenger composition comprises formaldehyde, methylene glycol, oxymethylene oligomers and/or a combination thereof.

In some embodiments, the aldehyde-based scavenger composition comprises a reaction product of an aldehyde and an alcohol. In such embodiments, the aldehyde comprises glyoxal, formaldehyde, glutaraldehyde and/or a combination thereof, and the alcohol comprises methanol, ethanol, propanol, isopropanol, glycerol, ethylene glycol, propylene glycol, diethylene glycol, triethylene glycol and/or a combination thereof.

The aldehyde-based scavenger composition can be provided in combination with a pH reduction agent. The pH reduction agent, which enhances the amine scavenging performance due to the synergy resulting from the reactivity of some amines with the aldehyde-based compound, and the formation of water-soluble amine salts at a low pH.

In some embodiments, the pH reduction agent comprises inorganic acids or their salts, organic acids or their salts, and/or a combination thereof. In some embodiments, the pH reduction agent comprises hydrochloric acid, sulfuric acid, acetic acid, formic acid, lactic acid, malic acid, glycolic acid, glyoxylic acid, oxalic acid, citric acid, sodium tripolyphosphate, polyacrylic acid, tartaric acid, and/or sodium hexametaphosphate.

The aldehyde-based scavenger composition is provided to a hydrocarbon. In some embodiments, the hydrocarbon comprises crude oil, desalted crude oil, slop oil, or other refinery products. The hydrocarbon as disclosed herein comprises a plurality of amines. In some embodiments, the plurality of amines comprise cyclohexylamine (CHXA), di-butyl amine (DBA), diethanolamine (DEA), diethylethanolamine (DEAE), diethylhydroxylamine (DEHA), diethylenetriamine (DETA), diglycolamine (DGA), diethyl amine (DIEA), dimethylamine (DMA), dipropyl amine (DIPA), dimethylisoproponolamine (DMIPA), dimethylaminoethanol (DMAE), dimethylaminopropylamine (DMAPA), ethyl amine (EA), dithiazine ethanol (DTZE), ethylene diamine (EDA), methylamine (MA), isopropyl amine (IPRA), N-methyldiethanolamine (MDEA), monoethanol amine (MEA), 2-Methylaminoethanol (MMEA), methyl dithiazane (MDTZ), monoisopropanolamine (MIPA), morpholine (MORPHO), methoxypropylamine (MOPA), N-Ethyldiethanolamine (NEDEA), propyl amine (PA), N-Ethyl morpholine (NEM), ethyl methyl amine (NMEA), 3-Picoline (PICO), N-methyl morpholine (NMM), piperazine (PIP), triethanol amine (TEA), triethyl amine (TETHA), trimethyl amine (TMA), urea (UREA), NN'-Bis(2-(2-hydroxyethoxy) ethyl)urea (BHEEU), 11'-(hydroxyimino)bis-2-propanol (HPHA), pyridine (PYR), NN-Bis(2-hydroxyethyl)ethylenediamine (BHEED), NNN'-Tris(2-hydroxyethyl)ethylenediamine (THEEDTRIS), NNN'N'-Tetrakis(2-hydroxyethyl)ethylenediamine (THEEDTETRA), NN-diethylethylenediamine (NNDEEDA), N-Ethyl-Piperazine (NEPIP), and/or NN'-Bis(2-(2-hydroxyethoxy)ethyl) thiourea (BHEETU).

In some embodiments, the aldehyde-based scavenger composition is present at a ratio of about 1:9 to about 9:1 based on the total amines present in the hydrocarbon. In other embodiments, the aldehyde-based scavenger composition is present at a ratio of about 1:5 to about 5:1 based on the total amines present in the hydrocarbon.

The present technology further provides for a method of scavenging amines. The method comprises (i) providing an aldehyde-based composition; and (ii) adding the aldehyde-based composition into crude oil. In some embodiments, the aldehyde-based scavenger composition is added to the crude oil prior to a desalter to extract (i.e. scavenge) amines during desalting in the desalter unit. It should be understood that crude oil as described herein can be present in any conventional refinery process, such as, but not limited to, a static, batch or continuous refinery process.

In some embodiments, the aldehyde-based scavenger composition comprises (i) glyoxal, (ii) a reaction product of ethylene glycol and formaldehyde, and/or (iii) a reaction product of glycerol and formaldehyde.

In some embodiments, the aldehyde-based scavenger composition provides at least about 25%-100% reduction in total amines present in the crude oil. In some embodiments, about 1-1500 ppm of the aldehyde-based scavenger composition is added to the hydrocarbon stream.

In some embodiments, the crude oil comprises a raw crude oil stream or a desalted crude stream. In some embodiments, the aldehyde-based scavenger composition can be added directly to raw crude, where the reaction products with amines may be removed via effluent brine.

The crude oil comprises a plurality of amines. The aldehyde-based scavenger reacts with the plurality of amines present in the crude oil to form non-salting molecules. In some embodiments, the plurality of amines comprise monoethanolamine, methoxypropylamine, diethanolamine, methylamine, dimethylethanolamine, dimethylisopropanolamine, and/or N-methylmorpholine.

The present technology further provides for a method of scavenging amines in desalted crude. In some embodiments, the aldehyde-based scavenger composition is added post-desalter (i.e. after the crude has left the desalter and prior to the distillation process) in a refinery system, which scavenges amines from the desalted crude oil prior to further refining. It should be understood that the desalted crude as described herein can be present in any conventional refinery process, such as, but not limited to, a static, batch or continuous refinery process.

It was shown that the aldehyde-based scavenger as described herein reacts with the amines present in crude oil or desalted crude oil in order to form non-salting molecules. It is well known that the reaction involves the addition of the amine to the carbonyl group of the aldehyde to form an imine, which further reacts to form complex reaction products. In some embodiments, the aldehyde-based scavenger reacts with the plurality of amines present in the crude oil or desalted crude oil to form non-salting molecules, which include, but are not limited to, imines, diimines, and/or complex addition reaction products. Subsequently, the reaction products obtained (which are composed of C, H, O and N), can be effectively removed by being distilled into the appropriate side draw of fractionator, and/or can be burned as fuel or safely decomposed in hydrotreaters. In some instances, the presence of water may inhibit the reaction, or a reverse product may be formed, and thus, the addition of the aldehyde-based scavenger composition prior to the hot train or crude unit furnace provides the benefit of vaporizing the water to facilitate the reaction.

In an exemplary embodiment, the method comprises (i) providing an aldehyde-based composition; and (ii) adding the aldehyde-based composition directly into desalted crude oil. In some embodiments, the aldehyde-based composition can be directly injected into the desalted crude oil. By adding or injecting the aldehyde-based composition directly into desalted crude oil, the salt point temperature can be reduced, thereby increasing the amount of opportunity crude in the charge.

In some embodiments, the desalted crude oil comprises a plurality of amines selected from the group consisting of monoethanolamine, methoxypropylamine, and diethanolamine.

In some embodiments, the aldehyde-based composition is present at a ratio of about 1:1 based on the total amines present in the desalted crude oil. In some embodiments, the aldehyde-based composition is present at a ratio of about 5:1 based on the total amines present in the desalted crude oil.

In some embodiments, the aldehyde-based composition comprises glyoxal. In some embodiments, the glyoxal composition is present at a ratio of about 1:1 based on the total amines present in the desalted crude oil. In some embodiments, the glyoxal composition is present at a ratio of about 5:1 based on the total amines present in the desalted crude oil. In some embodiments, the glyoxal composition provides a conversion percentage of at least about 25-100% of total amines present in the desalted crude oil.

In some embodiments, about 1-1500 ppm of the glyoxal composition is added to the desalted crude oil. In other embodiments, about 250 to 1500 ppm of the glyoxal composition is added to the desalted crude oil.

In some embodiments, the glyoxal provides an amine extraction percentage of at least about 0.5-50% from the desalted crude oil. In some embodiments, the glyoxal composition is provided in a 10% w/w water solution.

EXAMPLES

The present invention will be further described in the following examples, which should be viewed as being illustrative and should not be construed to narrow the scope of the disclosed technology or limit the scope to any particular embodiments.

Desalted crude oil was doped with different amounts of amines typically found in crude oils. Increasing amounts of glyoxal were added to crude, after which, the samples were analyzed for the concentration of amines before and after treatment. The experiments demonstrated that glyoxal reacted with the amines, effectively acting as an amine scavenging agent in desalted crude oil.

Example 1

Stock solutions of MEA, DEA, and glyoxal in butyl carbitol were prepared (5.0 mol/l each). About 100 ml of desalted crude oil were added to a graduated centrifuge tube. As shown in Table 1, the crude oil was dosed at 2 levels of total amines: (a) 1.0 mmol/l (0.5 mmol/l MEA+0.5 mmol/l DEA) and (b) 5.0 mmol/l (2.5 mmol/l MEA+2.5 mmol/l DEA)), and glyoxal (glyoxal at 2 molar ratios (with respect to total amines): (a) Glyoxal:Total amines=1:1; and (b) Glyoxal/Total amines=5:1).

TABLE 1

| Tube # | Total amines (mmol/l) | MEA (mmol/l) | DEA (mmol/l) | Glyoxal/Amines (mol/mol) | Glyoxal (mmol/l) |
|---|---|---|---|---|---|
| 1 | 1.0 | 0.5 | 0.5 | 0 | 0.0 |
| 2 | 1.0 | 0.5 | 0.5 | 1 | 1.0 |
| 3 | 1.0 | 0.5 | 0.5 | 5 | 5.0 |
| 4 | 1.0 | 0.5 | 0.5 | 5 | 5.0 |
| 5 | 5.0 | 2.5 | 2.5 | 0 | 0.0 |
| 6 | 5.0 | 2.5 | 2.5 | 1 | 5.0 |
| 7 | 5.0 | 2.5 | 2.5 | 1 | 5.0 |
| 8 | 5.0 | 2.5 | 2.5 | 5 | 25.0 |

Tubes were put in an oil bath for 30 min, after which were homogenized with a blender at 10,500 rpm for 10 seconds. Tubes were put back in the oil bath for another 30 min, after which were removed and let cool down. Crude oil was transferred to a glass bottle and analyzed. Analysis of amines in the crude oil was performed using a proprietary solid-phase extraction method.

The results in relation to Example 1 are shown in Table 2 below.

TABLE 2

| Tube # | Glyoxal ratio | Glyoxal (ppm) | Amine Level | Total Amines (ppm) | MEA (ppm) | DEA (ppm) | MEA Conversion % | DEA Conversion % |
|---|---|---|---|---|---|---|---|---|
| 1 | 0 | 0 | Low | 83.0 | 5.5 | 9.8 | 0.0 | 0.0 |
| 2 | 1 | 58 | Low | 83.0 | 2.8 | 6.0 | 49.1 | 38.8 |
| 3 | 5 | 290 | Low | 83.0 | 1.0 | 1.0 | 81.8 | 89.8 |
| 4 | 5 | 290 | Low | 83.0 | <1.0 | 1.1 | 81.8 | 88.8 |
| 5 | 0 | 0 | High | 416.0 | 39.6 | 93.0 | 0.0 | 0.0 |
| 6 | 1 | 290 | High | 416.0 | 5.6 | 14.7 | 85.9 | 84.2 |
| 7 | 1 | 290 | High | 416.0 | 11.2 | 15.6 | 71.7 | 83.2 |
| 8 | 5 | 1451 | High | 416.0 | 1.2 | <1.0 | 97.0 | 98.9 |

In FIGS. 1A-B, it was shown that the addition of the aldehyde-based scavenger (for example, glyoxal), decreased the concentration of amines present in the desalted crude. It is believed that such decrease in amine concentration is due to the reaction between the glyoxal and both MEA and DEA. (FIG. 1A provides for an amine level of 1.0 mmol/l (0.5 mmol/l MEA+0.5 mmol/l DEA), and FIG. 1B provides for an amine level of 5.0 mmol/l (2.5 mmol/l MEA+2.5 mmol/l DEA).)

Figures 2A, 2B:
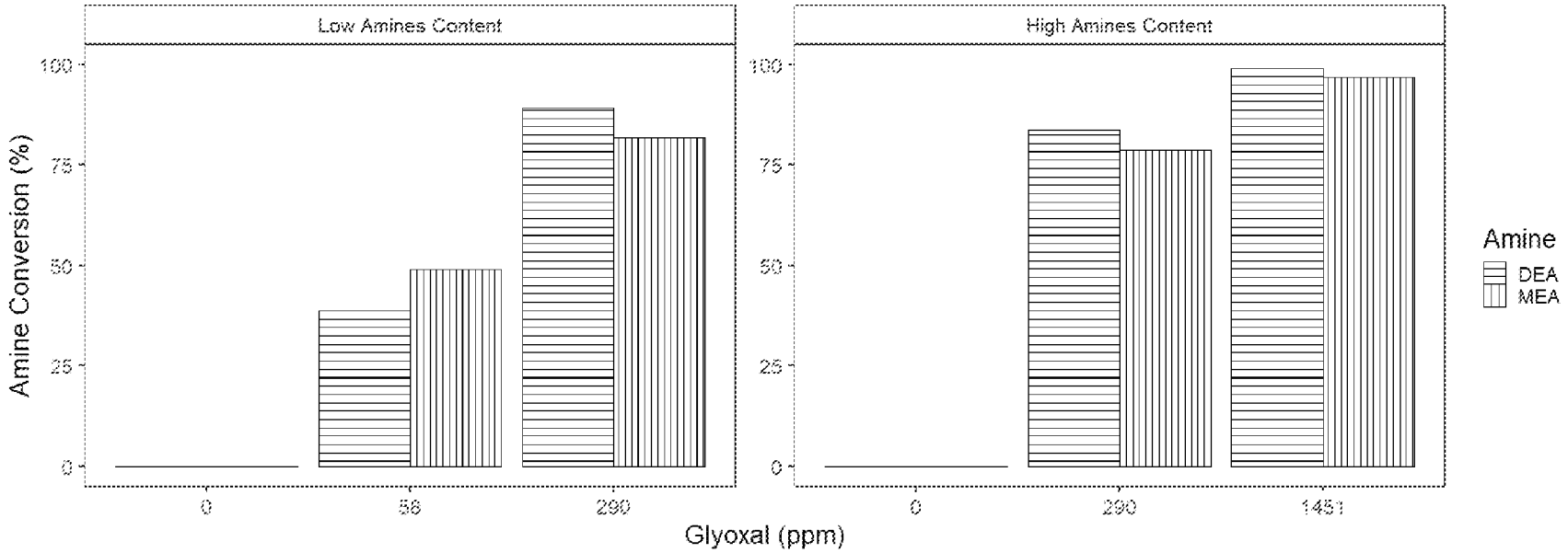
FIGS. 2A-B provide results of an illustrative embodiment of the disclosed technology.

In FIGS. 2A-B, the percentage amine conversion is shown, where a higher dosage of glyoxal exhibited a higher amine conversion percentage, (FIG. 2A provides for an amine level of 1.0 mmol/l (0.5 mmol/l MEA+0.5 mmol/l DEA), and FIG. 2B provides for an amine level of 5.0 mmol/l (2.5 mmol/l MEA+2.5 mmol/l DEA). It was shown that an excess of glyoxal (at about 5:1) achieved the highest amine conversion percentage.

Figure 3:
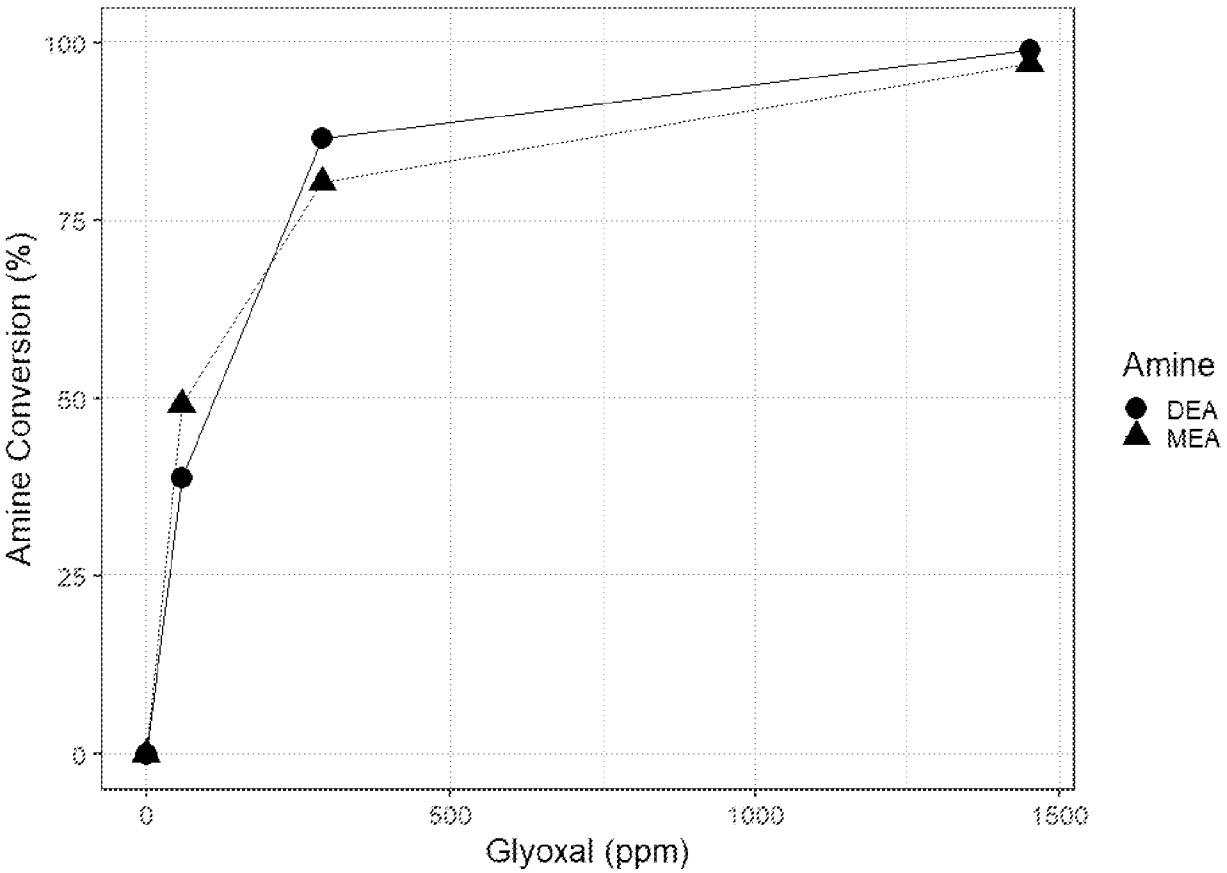
FIG. 3 provides the results of an illustrative embodiment of the disclosed technology.
Figures 4A, 4B:
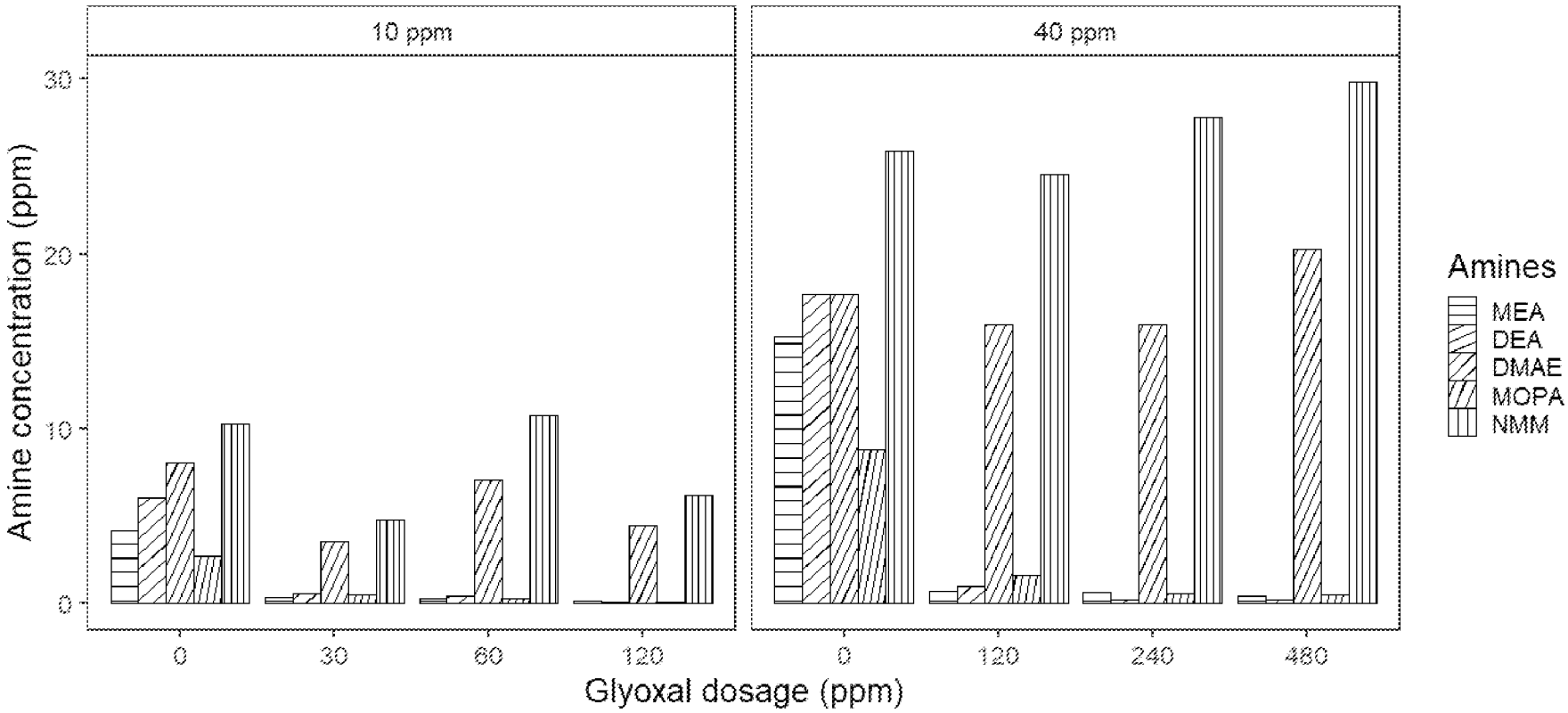
FIGS. 4A-B provide results of an illustrative embodiment of the disclosed technology.
Figures 5A, 5B:
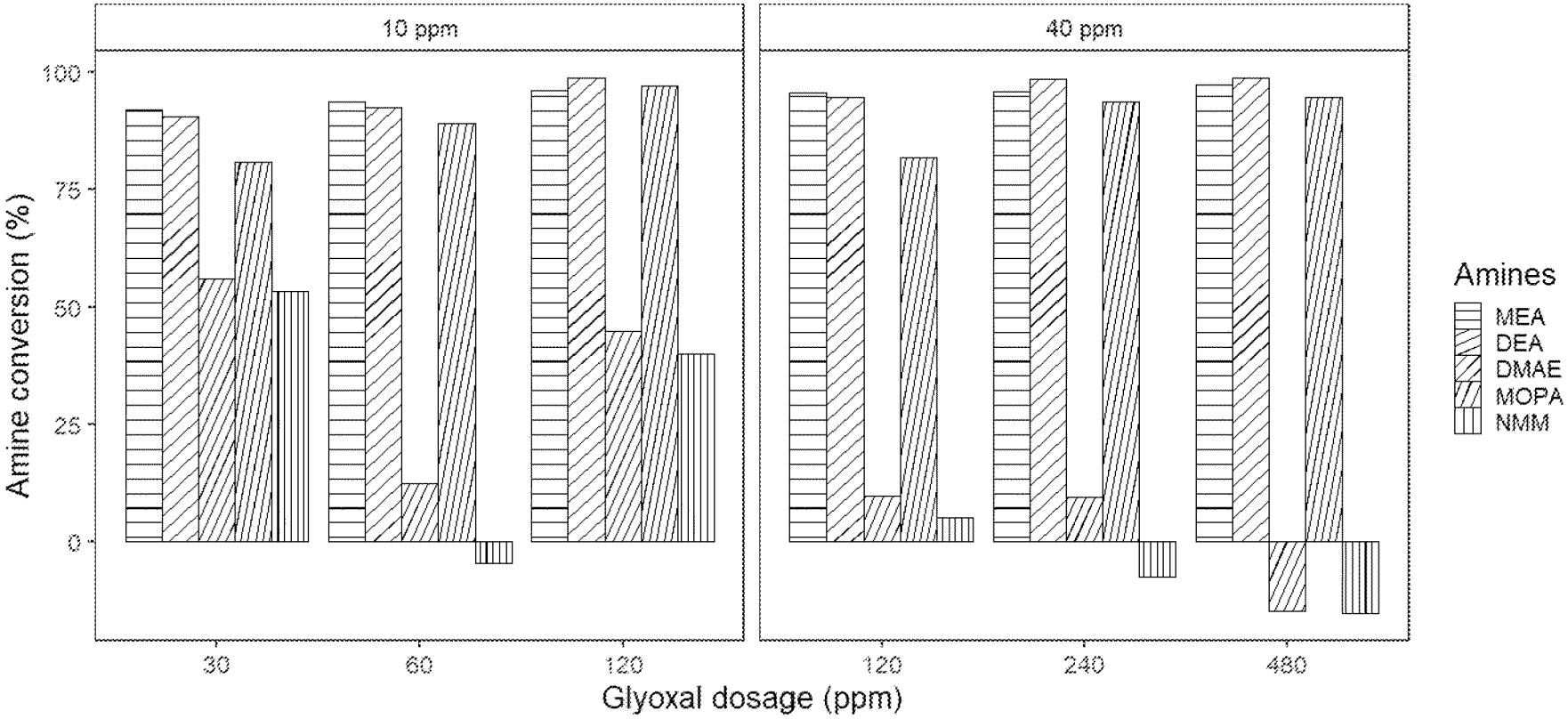
FIGS. 5A-B provide results of an illustrative embodiment of the disclosed technology.
Figures 6A, 6B, 6C, 6D:
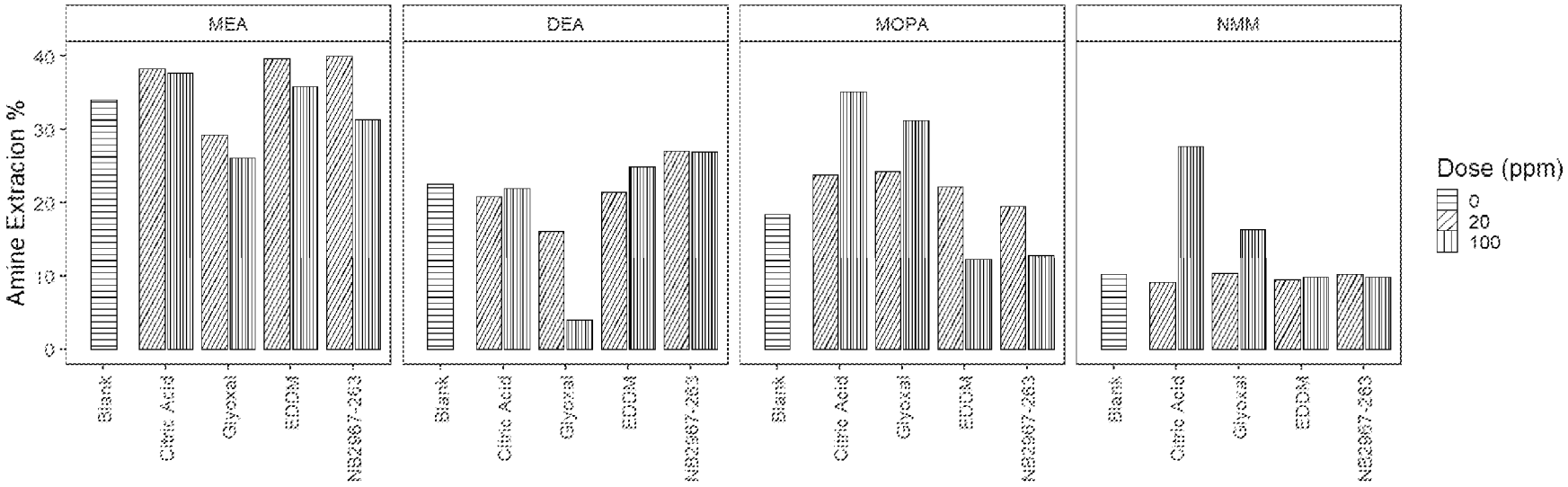
FIGS. 6A-D provide results of an illustrative embodiment of the disclosed technology.

FIG. 3 provides the results of the amine conversion in relation to the glyoxal dosage.

Example 2

As shown in Table 3, five amines were analyzed: monoethanolamine (MEA), diethanolamine (DEA), dimethylethanolamine (DMEA), ethoxypropylamine (MOPA), and N-methylmorpholine (NMM). Two levels of amines were provided: 10 ppm each (60 ppm total amines); and 40 ppm each (240 ppm total amines). A glyoxal to amines ratio added was based on a mass-based ratio (ppm) of (i) 0.5 to 1.0; (ii) 1.0 to 1.0; (iii) 2.0 to 1.0.

TABLE 3

| Tube # | Amines (ppm of each) | Glyoxal (ppm) | Glyoxal/Amines Mass Ratio |
|---|---|---|---|
| 1 | 10.0 | 0.0 | Blank 10 ppm (Each) |
| 2 | 10.0 | 30.0 | 0.5 |
| 3 | 10.0 | 60.0 | 1.0 |
| 4 | 10.0 | 120.0 | 2.0 |
| 5 | 40.0 | 0.0 | Blank 40 ppm (Each) |
| 6 | 40.0 | 120.0 | 0.5 |
| 7 | 40.0 | 240.0 | 1.0 |
| 8 | 40.0 | 480.0 | 2.0 |

FIGS. 4A-B and 5A-B provide the results of the amine concentration and amine conversion after treatment of the desalted crude with the disclosed treatment. Specifically, it was determined that the glyoxal reacted with the primary amines (MEA, MOPA) and the secondary amines (DEA).

Example 3

Four amine (MEA, DEA, MOPA, NMM) concentrations (100 ppm each) were provided in crude oil. Treatments of (i) glyoxal, (ii) citric acid, (iii) (ethylenedioxy)dimethanol (EDDM), which is a reaction product of ethylene glycol and formaldehyde, and (iv) NB2967-263, which is a reaction product of glycerol and formaldehyde, were added at 20 ppm and 100 ppm. Extraction was performed in a graduated centrifuge tube (10% water, 4,000 rpm for 2 second, 100° C.). Extraction efficiency was calculated assuming that all the amine can go into water (i.e., 1000 ppm). As shown in FIG. 6A-D, the percentage of amines extracted into water from crude oil is provided. It was shown that glyoxal reacted with MEA and DEA, whereas EDDM and NB2967-263 facilitated extraction of MEA and DEA, as well as MOPA.

In the foregoing specification, the invention has been described with reference to specific embodiments thereof. The scavengers of this method would be expected to be useful in other hydrocarbon processing operations besides those explicitly mentioned. While embodiments of the disclosed technology have been described, it should be understood that the present disclosure is not so limited and modifications may be made without departing from the disclosed technology. The scope of the disclosed technology is defined by the appended claims, and all devices, processes, and methods that come within the meaning of the claims, either literally or by equivalence, are intended to be embraced therein.

The invention claimed is:

1. A method of scavenging ammonia and amines, the method comprising:

(i) providing an aldehyde-based scavenger composition; and (ii) adding the aldehyde-based scavenger composition to a hydrocarbon, wherein the hydrocarbon comprises a plurality of amines, wherein the aldehyde-based scavenger composition is present at a molar ratio of about 1:9 to about 9:1 based on the total amines present in the hydrocarbon.

2. The method as recited in claim 1, wherein the aldehyde-based scavenger composition comprises glyoxal, tetrahydroxyethane, dihydroxymethyl dioxolanediol, bi-dioxolane tetrol, formaldehyde, methylene glycol, oxymethylene oligomers, and/or a combination thereof.

3. The method as recited in claim 1, wherein the aldehyde-based scavenger composition comprises a reaction product of an aldehyde and an alcohol, and wherein the aldehyde comprises glyoxal, formaldehyde, glutaraldehyde and/or a combination thereof, and the alcohol comprises methanol, ethanol, propanol, isopropanol, glycerol, ethylene glycol, propylene glycol, diethylene glycol, triethylene glycol and/or a combination thereof.

4. The method as recited in claim 1, wherein the aldehyde-based scavenger composition is provided in combination with a pH reduction agent, and wherein the pH reduction agent comprises inorganic acids or their salts, organic acids or their salts, and/or a combination thereof.

5. The method as recited in claim 4, wherein the pH reduction agent comprises citric acid, sodium tripolyphosphate, polyacrylic acid, tartaric acid, and/or sodium hexametaphosphate.

6. The method as recited in claim 1, wherein the hydrocarbon comprises a plurality of amines, and wherein the plurality of amines comprise cyclohexylamine, di-butyl amine, diethanolamine, diethylethanolamine, diethylhydroxylamine, diethylenetriamine, diglycolamine, diethyl amine, dimethylamine, dipropyl amine, dimethylisoproponolamine, dimethylaminoethanol, dimethylaminopropylamine, ethyl amine, dithiazine ethanol, ethylene diamine, methylamine, isopropyl amine, N-methyldiethanolamine, monoethanol amine, 2-Methylaminoethanol, methyl dithiazane, monoisopropanolamine, morpholine, methoxypropylamine, N-Ethyldiethanolamine, propyl amine, N-Ethyl morpholine, ethyl methyl amine, 3-Picoline, N-methyl morpholine, piperazine, triethanol amine, triethyl amine, trimethyl amine, urea, NN'-Bis(2-(2-hydroxyethoxy)ethyl)urea, 11'-(hydroxyimino)bis-2-propanol, pyridine, NN-Bis(2-hydroxyethyl)ethylenediamine, NNN'-Tris(2-hydroxyethyl)ethylenediamine, NNN'N'-Tetrakis(2-hydroxyethyl)ethylenediamine, NN-diethylethylenediamine, N-Ethyl-Piperazine, and/or NN'-Bis(2-(2-hydroxyethoxy)ethyl)thiourea.

7. The method as recited in claim 1, wherein the aldehyde-based scavenger composition is added to the hydrocarbon in (i) a single stage desalter process, (ii) a second stage of a two-stage desalter process, (iii) in all stages of a multi-stage desalting process, (iv) in the desalted crude, or (v) in fractionator pump-arounds or naphtha overhead recycle.

8. A method of scavenging amines, the method comprising:

(i) providing an aldehyde-based composition; and (ii) adding the aldehyde-based composition to crude oil, wherein about 1-1500 ppm of the aldehyde-based scavenger composition is added to the crude oil, said crude oil comprising a plurality of amines, wherein the aldehyde-based scavenger composition is present at a molar ratio of about 1:9 to about 9:1 based on the total amines present in the crude oil.

9. The method as recited in claim 8, wherein the aldehyde-based scavenger composition comprises (i) glyoxal, (ii) a reaction product of ethylene glycol and formaldehyde, and/or (iii) a reaction product of glycerol and formaldehyde.

10. The method as recited in claim 8, wherein the aldehyde-based scavenger provides at least about 25%-100% reduction in total amines present in the crude oil.

11. The method as recited in claim 8, wherein the crude oil comprises a hydrocarbon, a raw crude oil, or a desalted crude.

12. The method as recited in claim 8, wherein the plurality of amines comprise cyclohexylamine, di-butyl amine, diethanolamine, diethylethanolamine, diethylhydroxylamine, diethylenetriamine, diglycolamine, diethylamine, dimethylamine, dipropyl amine, dimethylisoproponolamine, dimethylaminoethanol, dimethylaminopropylamine, dimethylethanolamine, dimethylisopropanolamine, ethyl amine, dithiazine ethanol, ethylene diamine, methylamine, isopropyl amine, N-methyldiethanolamine, monoethanol amine, 2-Methylaminoethanol, methyl dithiazane, monoisopropanolamine, morpholine, methoxypropylamine, N-Ethyldiethanolamine, propyl amine, N-Ethyl morpholine, ethyl methyl amine, 3-Picoline, N-methyl morpholine, piperazine, triethanol amine, triethyl amine, trimethyl amine, urea, NN'-Bis(2-(2-hydroxyethoxy)ethyl)urea, 11'-(hydroxyimino)bis-2-propanol, pyridine, NN-Bis(2-hydroxyethyl)ethylenediamine, NNN'-Tris(2-hydroxyethyl)ethylenediamine, NNN'N'-Tetrakis(2-hydroxyethyl)ethylenediamine, NN-diethylethylenediamine, N-Ethyl-Piperazine, and/or NN'-Bis(2-(2-hydroxyethoxy)ethyl)thiourea.

13. The method as recited in claim 8, wherein the aldehyde-based scavenger reacts with the plurality of amines present in the crude oil to form non-salting molecules.

14. A method of scavenging amines in desalted crude, the method comprising:

(i) providing an aldehyde-based composition; and (ii) adding the aldehyde-based composition directly into desalted crud, the desalted crude comprising a plurality of amines, wherein the aldehyde-based scavenger composition is present at a molar ratio of about 1:9 to about 9:1 based on the total amines present in the desalted crude.

15. The method as recited in claim 14, wherein the desalted crude comprises a plurality of amines comprising cyclohexylamine, di-butyl amine, diethanolamine, diethylethanolamine, diethylhydroxylamine, diethylenetriamine, diglycolamine, diethyl amine, dimethylamine, dipropyl amine, dimethylisoproponolamine, dimethylaminoethanol, dimethylaminopropylamine, ethyl amine, dithiazine ethanol, ethylene diamine, methylamine, isopropyl amine, N-methyldiethanolamine, monoethanol amine, 2-Methylaminoethanol, methyl dithiazane, monoisopropanolamine, morpholine, methoxypropylamine, N-Ethyldiethanolamine, propyl amine, N-Ethyl morpholine, ethyl methyl amine, 3-Picoline, N-methyl morpholine, piperazine, triethanol amine, triethyl amine, trimethyl amine, urea, NN'-Bis(2-(2-hydroxyethoxy)ethyl)urea, 11'-(hydroxyimino)bis-2-propanol, pyridine, NN-Bis(2-hydroxyethyl)ethylenediamine, NNN'-Tris(2-hydroxyethyl)ethylenediamine, NNN'N'-Tetrakis(2-hydroxyethyl)ethylenediamine, NN-diethylethylenediamine, N-Ethyl-Piperazine, and/or NN'-Bis(2-(2-hydroxyethoxy)ethyl)thiourea.

16. The method as recited in claim 14, wherein the aldehyde-based composition comprises glyoxal, and wherein the glyoxal is present at a molar ratio of (i) about 1:1 based on the total amines present in the desalted crude, or (ii) about 5:1 based on the total amines present in the desalted crude.

17. The method as recited in claim 16, wherein the glyoxal provides a conversion percentage of at least about 25-100% of total amines present in the desalted crude.

18. The method as recited in claim 16, wherein about 1-1500 ppm of the glyoxal composition is added to the desalted crude, fractionator pump-arounds or naphtha overhead recycle.

19. The method as recited in claim 16, wherein the glyoxal provides an amine extraction percentage of at least about 0.5-50% from the desalted crude.

20. A method of scavenging ammonia and amines, the method comprising:

(i) providing an aldehyde-based scavenger composition; and (ii) adding the aldehyde-based scavenger composition to a hydrocarbon, wherein the hydrocarbon comprises a plurality of amines, wherein the aldehyde-based scavenger composition is provided in combination with a pH reduction agent, and wherein the pH reduction agent comprises inorganic acids or their salts, organic acids or their salts, and/or a combination thereof, wherein the pH reduction agent comprises citric acid, sodium tripolyphosphate, polyacrylic acid, tartaric acid, and/or sodium hexametaphosphate.

* * * * *